US005732470A

United States Patent [19]

Labarbara

[11] Patent Number: 5,732,470

[45] Date of Patent: Mar. 31, 1998

[54] OSCILLATING RAZOR

[75] Inventor: A. Franklin Labarbara, Providence, R.I.

[73] Assignee: Good Marketing, Inc., Cleveland, Ohio

[21] Appl. No.: 598,743

[22] Filed: Feb. 8, 1996

[51] Int. Cl.[6] ..... B26B 21/38

[52] U.S. Cl. ..... 30/45; 30/44

[58] Field of Search ..... 30/45, 44, 210, 30/537, DIG. 1

[56] References Cited

U.S. PATENT DOCUMENTS

| | | | |
|---|---|---|---|
| 1,200,493 | 10/1916 | Harshberger | 30/45 |
| 1,208,491 | 12/1916 | Conill | 30/45 |
| 2,112,402 | 3/1938 | Jaffe | 30/44 |
| 2,512,499 | 6/1950 | Loosen | 30/45 X |
| 2,552,688 | 5/1951 | Partridge | 30/44 X |
| 3,196,299 | 7/1965 | Kott | 30/DIG. 1 X |
| 3,509,626 | 5/1970 | Mead | 30/45 |
| 3,611,568 | 10/1971 | Alexander et al. . | |
| 3,636,627 | 1/1972 | Tiffin . | |
| 3,793,723 | 2/1974 | Kuris et al. . | |
| 4,744,144 | 5/1988 | Lowery, Sr. et al. . | |
| 4,819,330 | 4/1989 | Fenn et al. . | |
| 5,007,169 | 4/1991 | Motta . | |
| 5,046,249 | 9/1991 | Kawara et al. | 30/45 |
| 5,214,851 | 6/1993 | Althaus . | |
| 5,299,354 | 4/1994 | Metcalf et al. . | |

FOREIGN PATENT DOCUMENTS

| | | | |
|---|---|---|---|
| 911412 | 7/1946 | France | 30/45 |
| 651221 | 10/1937 | Germany | 30/44 |
| 429964 | 6/1935 | United Kingdom | 30/45 |

*Primary Examiner*—Eugenia Jones

*Attorney, Agent, or Firm*—Pearne, Gordon, McCoy & Granger LLP

[57] ABSTRACT

A detachable oscillating unit is provided which converts a conventional wet shave razor, such as a disposable razor, into an oscillating wet shave razor. The oscillating unit includes a body forming a hollow interior cavity and a pair of attachment members which are fixed to the body for removably attaching the body to the handle of the razor. The attachment members form a longitudinal channel which receives the handle therein and the handle is resiliently clamped or gripped therebetween. The oscillating unit also includes an electric motor mounted within the hollow interior cavity which has a rotatable shaft extending therefrom, an eccentric weight connected to the shaft and disposed within the hollow cavity, and a battery operatively connected to the motor. The motor rotates the eccentric weight to provide a vibration signal which is transmitted from the motor, through the body and the attachment members, to the handle of the razor where it is transmitted to a cutting blade.

11 Claims, 3 Drawing Sheets

OSCILLATING RAZOR

BACKGROUND OF THE INVENTION

1. Field of the Invention

The present invention generally relates to an oscillating wet shave razor and, more particularly, to an oscillating unit which is removably attachable to a conventional wet shave razor such as, for example, a disposable razor to send a vibration signal to a cutting blade of the razor.

2. Description of the Related Art

Electric razors typically impart an Oscillating or vibratory signal to a cutting element in order to improve the ease of cutting. Traditional electric razors, also known as dry shavers, are typically used without soap and water, or shaving cream. Although the electric razors may provide a satisfactory shave, many individuals believe that the shave provided by the electric razor is not as close as a shave provided by a wet shave razor. Wet shave razors are believed to obtain a close shave because they are used with soap and water or shaving cream to soften individual hairs of the beard.

There have been many attempts to provide an oscillating wet shave razor which combines the beard softening action of the wet shave razor with the vibratory action of the electric dry shave razor. See U.S. Pat. Nos. 3,636,627, 4,744,144, 4,819,330, 5,007,169, 5,214,851, and 5,299,354, the disclosures of which are expressly incorporated herein in their entirety by reference, for examples of such prior art oscillating wet shave razors. It is impractical to plug the oscillating wet shave razors into an electrical outlet because the oscillating wet shave razors are used in an environment of water. Thus, an electric motor and power source, typically a battery, are housed within the handle of the razor. The oscillating wet shave razors, however, are relatively expensive.

SUMMARY OF THE INVENTION

The present invention provides a detachable oscillating unit which attaches to a handle of a wet shave razor to obtain an oscillating wet shave razor which overcomes at least some of the problems of the related art. The oscillating unit includes a body forming a hollow interior cavity and at least one attachment member fixed to the body for removably attaching the body to the handle of the razor. The oscillating unit also includes a motor mounted within the hollow interior cavity and having a rotatable shaft extending therefrom, an eccentric weight connected to the shaft and disposed within the hollow cavity for rotation to induce a vibration signal, and a battery operatively connected to the motor. The oscillating unit can be easily attached to the handle of a variety of conventional wet shave razors. Therefore, the oscillating unit can be attached to an existing wet shave razor such as, for example, a disposable razor and does not have to be replaced each time the wet shave razor is replaced. The oscillating unit can be advantageously used with relatively inexpensive disposable razors.

BRIEF DESCRIPTION OF THE DRAWINGS

These and further features of the present invention will be apparent with reference to the following description and drawings, wherein.

DETAILED DESCRIPTION OF PREFERRED EMBODIMENTS

Figure 1:
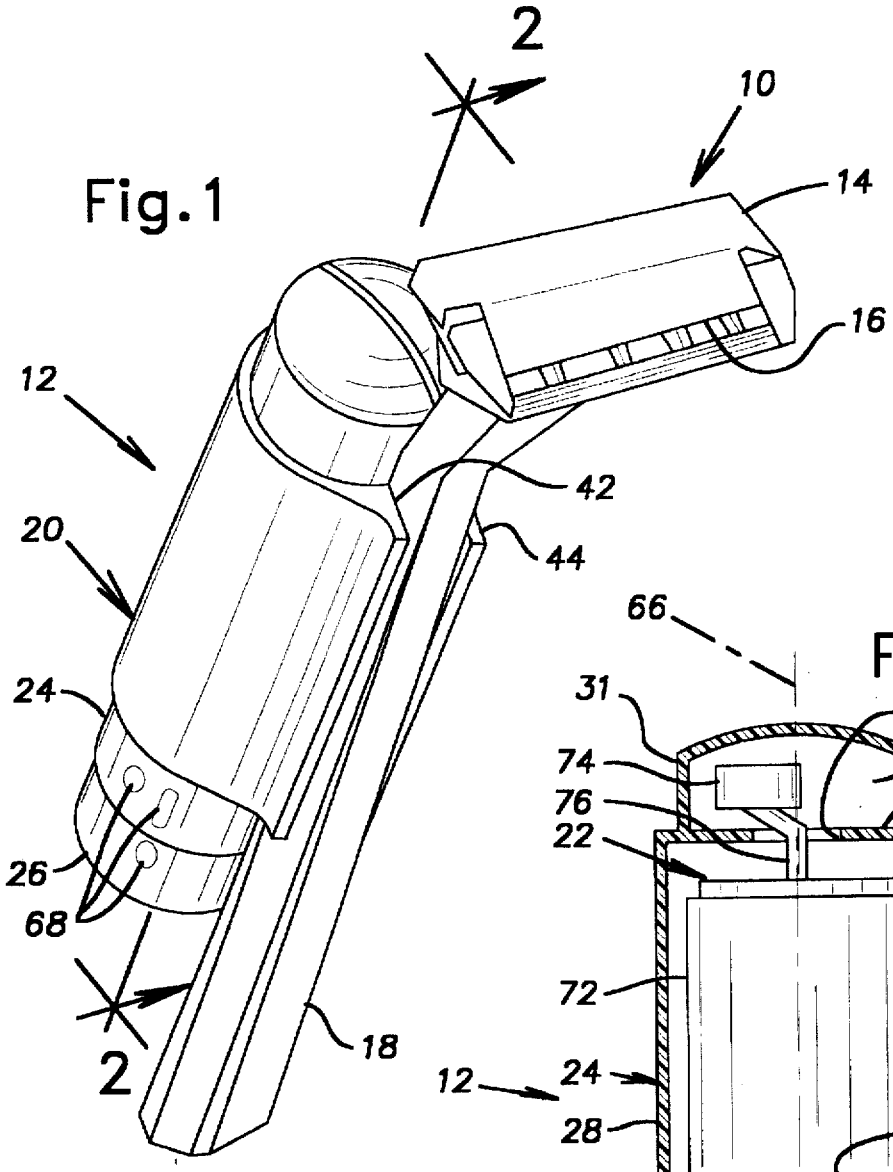
FIG. 1 is a perspective view of a razor with a detachable oscillating unit according to the present invention.

FIGS. 1 illustrates a razor 10 with a detachable oscillating unit 12 according to the present invention. The illustrated razor 10 is a conventional disposable wet shave razor having a head portion 14 with at least one cutting blade 16 and a handle portion 18. It is noted that any conventional wet shave razor could be utilized within the scope of the present invention. The oscillating unit 12 includes a hollow housing 20 and vibration inducing means 22 (FIG. 2) disposed within the hollow body 20. The hollow housing 20 includes a generally cylindrically-shaped body 24 which has an open distal end and an end cap 26 which closes the open distal end of the body 24.

Figure 2:
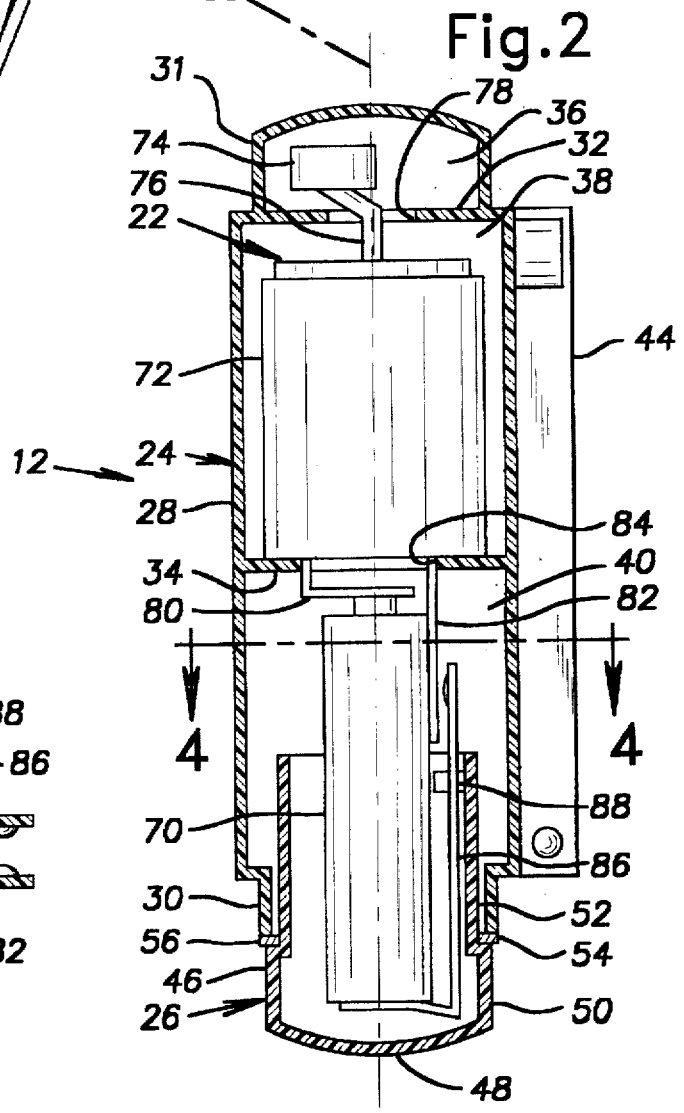
FIG. 2. is an elevational view, in partial cross-section, of the oscillating unit taken along line 2—2 of FIG. 1.

As best shown in FIG. 2, the housing body 24 includes a generally-cylindrically shaped sidewall 28 which forms a hollow interior cavity. The distal or bottom end of the sidewall includes a portion 30 having a reduced diameter and the proximal or top end of the side wall includes a portion 31 having a reduced diameter. A first or upper partition wall 32 and a second or lower partition wall 34 extend from the sidewall 28 to divide the hollow interior into upper, intermediate, and lower chambers 36, 38, 40.

Extending outwardly from the exterior surface of the side wall 28 are a pair of elongate attachment members 42, 44 integral with the body 24. The attachment members 42, 44 together form a longitudinally extending channel which is sized for receiving and clamping the handle portion 18 of the razor 10. The attachment members 42, 44 preferably comprise a flexible material so that they resiliently deflect laterally outward as the handle portion 18 is inserted between the clamping members 42, 44 and firmly clamp or grip the handle portion 18 between them to attach the oscillating unit 12 to the razor 10. Alternatively, the attachment members 42, 44 can angle or converge toward each other, forming a decreasing distance between them so that the handle portion 18 of the razor 10 can be wedged therebetween to attach the oscillating unit 12 to the razor 10.

The body 24 is preferably comprised of plastic material suitable for transmitting vibration signals. The body 24 also preferably formed by two halves **24*a*, 24*b* which are symmetrical about a longitudinally extending dividing plane. The two body halves 24*a*, 24*b*** are attached together by a suitable attachment means such as, for example, an adhesive which forms a water-tight seal.

As best shown in FIG. 2, the end cap 26 includes a generally cylindrically shaped sidewall 46 which is closed at a distal end by an end wall 48. The sidewall 46 has a first or lower portion 50 extending from the end wall 48 and a second or upper portion 52 extending from the first portion 50. The upper portion 52 of the end cap sidewall 46 has an outer diameter sized for mating with the inner diameter of the reduced diameter portion 30 of the body 24 to allow rotational movement of the end cap 26 relative to the body 24. The lower portion 50 of the end cap 26 has an outer diameter larger than the outer diameter of the upper portion 52 to form an annularly-shaped abutment 54. A generally-annularly shaped gasket 56 is provided between the abutment 54 and the end of the body 24 so that a water-tight seal is obtained between the end cap 26 and the body 24.

Figure 3:
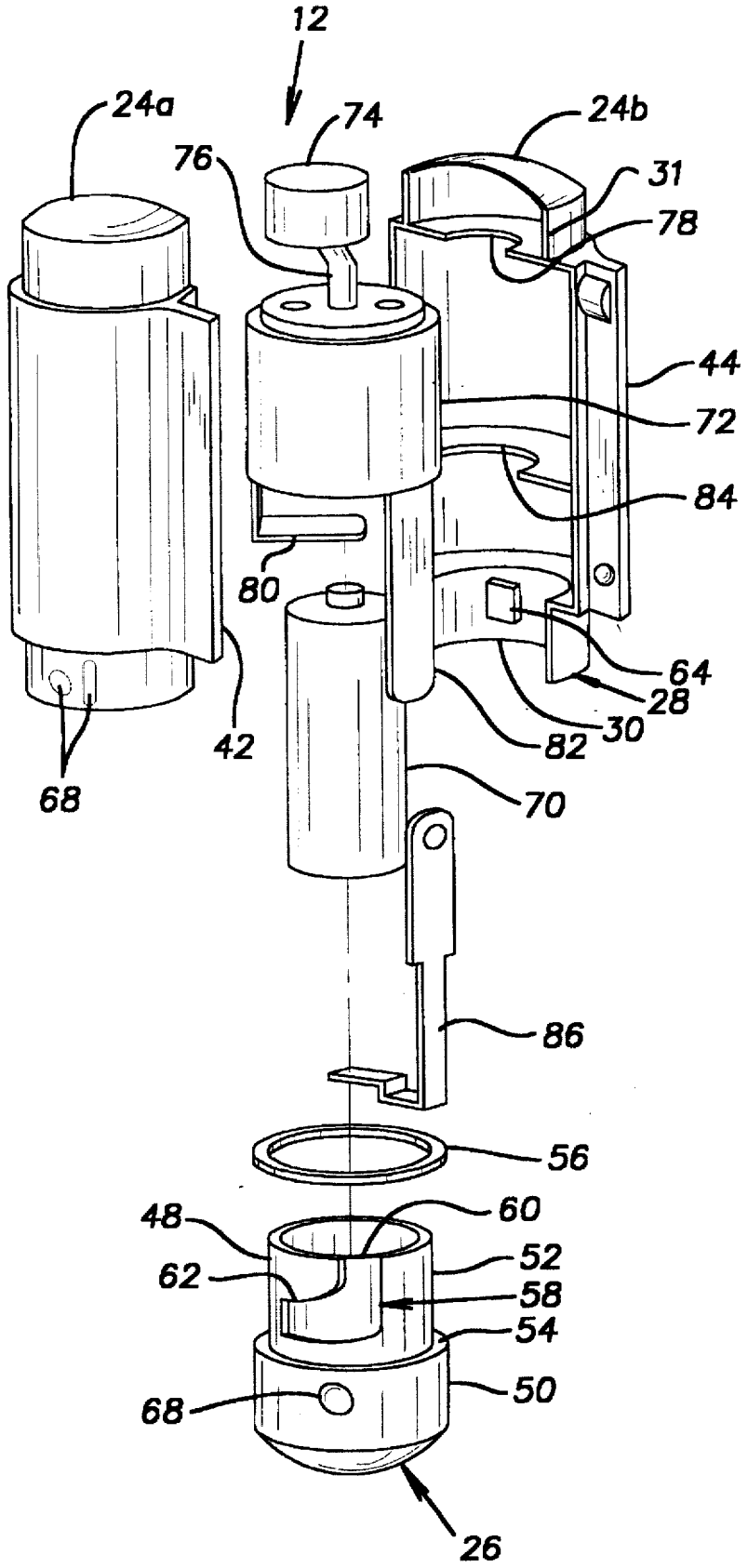
FIG. 3 is an exploded view of the oscillating unit of FIG. 1.

As best shown in FIG. 3, a pair of "L"-shaped grooves 58 (only one of the grooves 58 being visible in FIG. 3) are formed in the upper portion 52 of the end cap sidewall 46. The grooves 58 are located on opposite sides of the end cap 26, that is, located about 180 degrees apart at the outer surface of the sidewall upper portion 52. Each groove 58 has an first portion 60 which axially extends from the proximal end of the end cap 26 and a second portion 62 which circumferentially extends from the distal end of the first portion 60 substantially perpendicular to the first portion 60. The grooves 58 are sized, shaped, and located to receive a pair of protrusions 64 which extend inward from the inner surface of the reduced diameter portion 30 of the sidewall 28 of the body 24. The illustrated protrusions 64 are generally rectangularly-shaped and located on opposite sides of the body 24, that is, located about 180 degrees apart.

The end cap 26 is rotatable about the central axis 66 of the unit 12 relative to the body 24. The end cap 26 is rotatable between three positions: a first or removal-position; a second or off-position; and a third or on-position. In the removal-position, the end cap 26 is oriented so that the protrusions 64 are aligned with the first portion 60 of the grooves 58 so that the end cap 26 can be axially moved relative to the body 24 and removed from the body 24. In the off-position, the end cap 26 is slightly rotated from the removal-position so that the protrusions 64 are within the second portion 62 of the grooves 58. In this position, the end cap 26 cannot axially move relative to the body 24 but can be rotated relative to the body 24 about the central axis 62 to either the removal-position or the on-position. In the on-position, the end cap 26 is rotated from the off-position, in a direction opposite the removal-position, so that the protrusions 64 are located near the end of the second portion 62 of the grooves 58. Preferably, means 68 for indicating the position Of the end cap 26 is provided on the exterior surface of the body 24 and end cap 26 such as, for example, protrusions, indentations, labels, or ink, paint and other types of markings.

As best shown in FIG. 2, the vibration inducing means 22 includes a battery 70, an electric motor 72, and an eccentric weight 74. The battery 70 is a conventional such as, for example, a AA 1.5 volt battery. The battery 70 is disposed within the body 24 in the lower chamber 40 and extends into the end cap 26. The electric motor 72 is disposed within body 24 in the intermediate chamber 38 and is preferably bonded in place with a suitable adhesive so as to make a water-tight seal. The electric motor 72 includes a rotatable shaft 76 which extends from the proximal end of the electric motor 72, in the direction of the head portion 14 of the razor 10, and has a rotational axis coaxial with the central longitudinal axis 66 of the housing 20. The shaft 76 extends through an opening 78 in the upper partition wall 32 and into the upper chamber 36. The weight 74 is within the upper chamber 36 and mounted on a free end of the shaft 76 which is bent outwardly from the central axis 66 so that the weight 74 is eccentrically mounted, that is, the center of gravity of the weight 74 is offset from the axis of rotation 66 of the weight 74. As best shown in FIG. 2, the illustrated weight 74 is a flywheel type weight with its center of gravity radially moved from the axis of rotation 66 of the shaft 76.

Positive and negative electrical contacts 80, 82 extend from the distal end of the motor 72 through an opening 84 in the lower partition wall 34 and into the lower chamber 40. The positive electrical contact 80 is formed to electrically contact the proximal or positive end of the battery 70. The negative electrical contact 82 is formed to extend axially adjacent the outer surface of an upper portion of the battery 70. An on-off electrical contact 86 is formed such that a first end is in electrical contact with the distal or negative end of the battery 70 within the end cap 26 and a second end is located radially outward of the negative electrical contact 82. The on-off electrical contact 86 is not in electrical contact with the negative electrical contact 82 when the end cap 26 is in the removal-position or the off-position.

Figure 4:
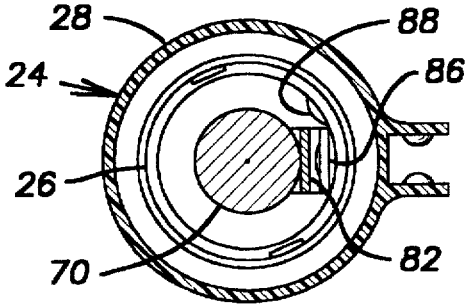
FIG. 4 is a cross-sectional view of the oscillating unit taken along line 4—4 of FIG. 2.

As best shown in FIG. 4, a cam element 88 is located on the inner surface of the sidewall upper portion 52 of the end cap 26. The cam element 88 is located adjacent the on-off electrical contact 86 when the end cap 26 is in the off-position. The cam element 88 is shaped and positioned so that the cam element 88 inwardly deflects the on-off electrical contact 86 toward and into electrical contact with the negative electrical contact 82 when the end cap 26 is rotated to the on-position. When the on-off electrical contact 86 is in electrical contact with the negative electrical contact 82, the electrical circuit is complete and the motor 72 rotates the shaft 76 and the weight 74. When the end cap 26 is rotated back to the intermediate or off-position, the on-off electrical contact 86 resiliently deflects or springs outward to break the electrical contact with the negative electrical contact 82 so that the electrical circuit is open and the motor 72 stops rotating the shaft 76 and the weight 74. The battery 70 and the on- off electrical contact 86 are held in a manner to prevent rotation with the end cap 26. It is noted that other suitable configurations can be utilized for switching the motor 72 on and off can be utilized such as, for example, the on-off electrical contact can rotate with the end cap to go into and out of electrical contact with the negative electrical contact.

In operation, the oscillating unit 12 is attached to the razor 10 by snapping the handle portion 18 of the razor 10 between the attachment members 42, 44. The operator rotates the end cap 26 is rotated from the off-position to the on-position where the on-off electrical contact 86 is in electrical contact with the negative electrical contact 82 so that electrical energy from the battery 70 is directed toward the motor 72. Energization of the motor 70 causes rotation of the shaft 76 and thereby rotation of the eccentrically mounted or unbalanced weight 74 the eccentricity of the weight mounting induces a vibration signal which is transmitted to the head portion 14 of the razor 10 containing the blade 16. The vibration signal is transmitted from the shaft 76, through the motor 72, through the body 24, through the attachment members 42, 44, through the handle portion 18, and through the head portion 14 to the cutting blade 16. The vibration signal imparts a motion to said cutting blade 16 which reduces the coefficient of friction between the cutting blade 16 and the face of the user to facilitate shaving comfort. The vibration signal may additionally impart a slicing motion to the cutting blade 16 to facilitate ease of cutting. After the shaving operation, the end cap 26 is rotated back to the off-position which disengages the on-off electrical contact 86 from the negative electrical contact 82 and interrupts the circuit of the motor 72.

Figure 5:
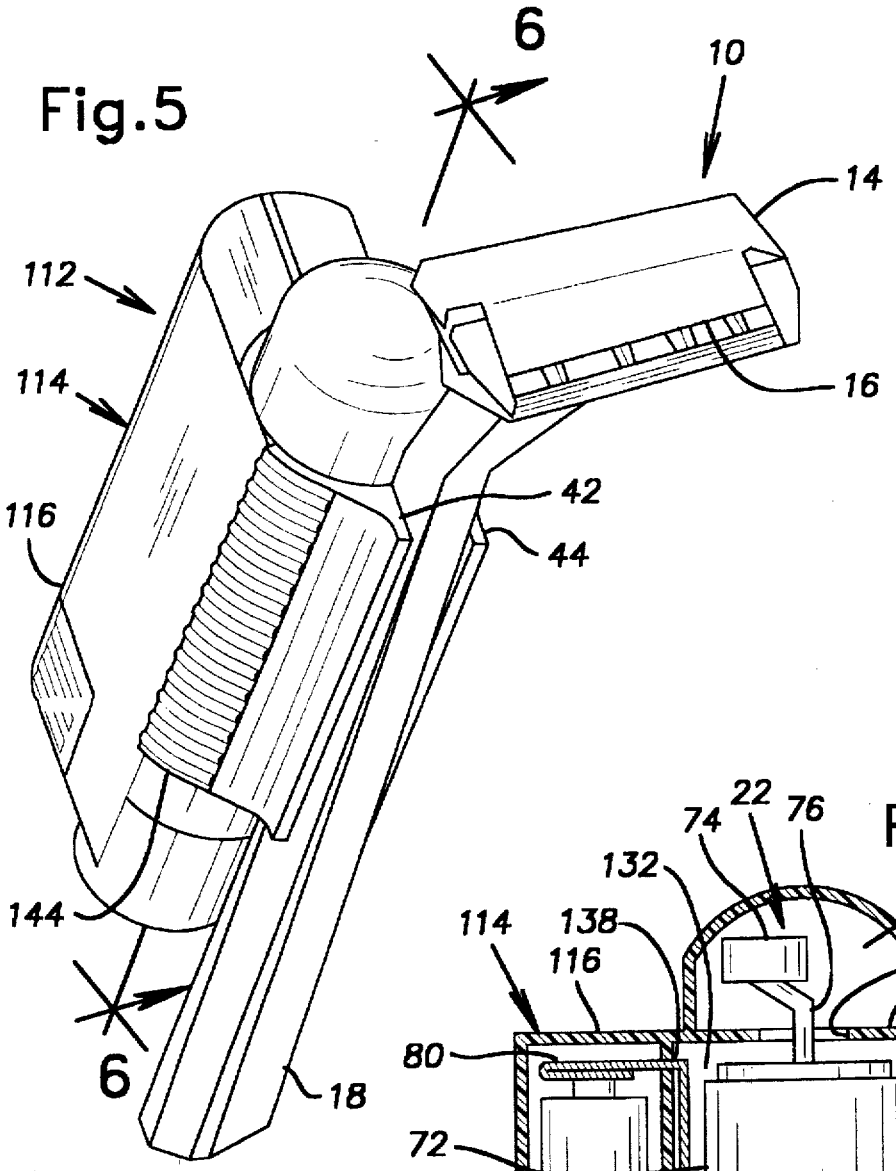
FIG. 5 is a perspective view of a razor with a detachable oscillating unit according to a second embodiment of the present invention.
Figure 6:
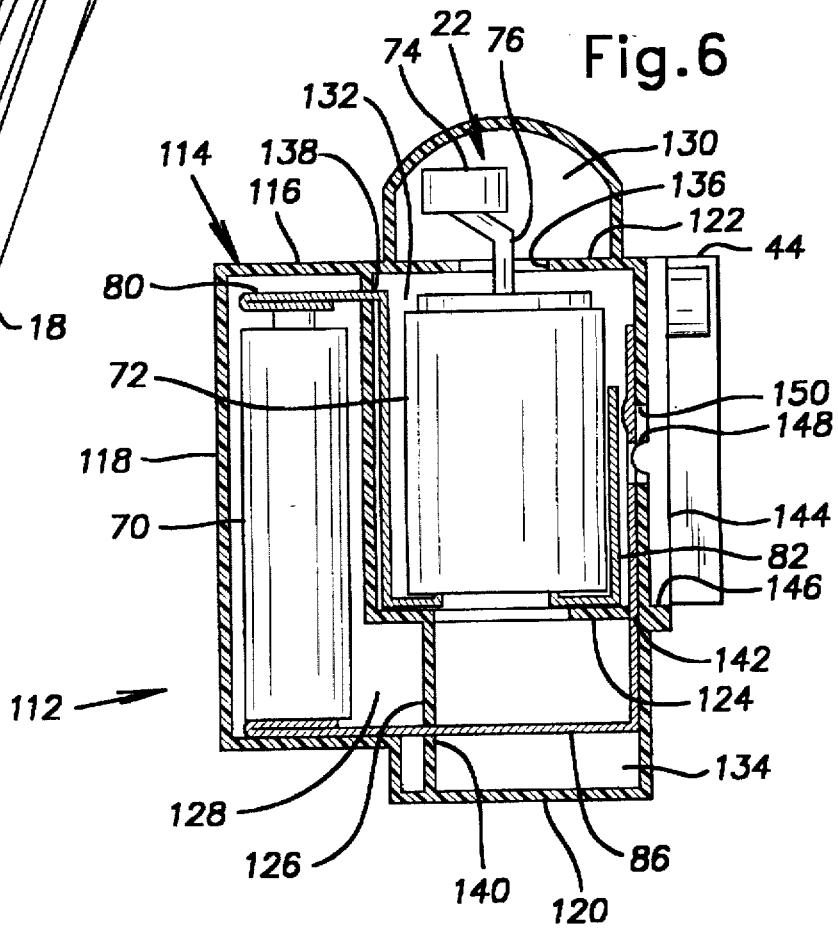
FIG. 6 is an elevational view, in partial cross-sectional, of the oscillating unit taken along line 6—6 of FIG. 5.

FIGS. 5 and 6 illustrate a second embodiment of the detachable oscillating unit 112 according to the present invention wherein similar reference numerals are used for similar structure. The oscillating unit 112 includes a hollow housing 114 which is more compact than the housing 20 of the first embodiment. The hollow housing 114 includes a body 116 which has an Open back side and an access door 118 which closes the open back side of the body 116.

As best shown in FIG. 6, the housing body 116 includes an outer wall 120 which forms a hollow interior cavity therein. A first or upper partition wall 122, a second or lower partition wall 124, and a side partition wall 126 extend from the outer wall 120 to divide the hollow interior into back, upper, intermediate, and lower chambers 128, 130, 132, 134.

As best shown in FIG. 6, the battery 70 of the vibration inducing means 22 is disposed within the body 116 in the back chamber 128. The battery 70 can be exchanged by removing and replacing the access door 118. The electric motor 72 is disposed within the body 116 in the intermediate chamber 132 and is preferably bonded in place with a suitable adhesive so as to form a water-tight seal. The shaft 76 extends through an opening 136 in the upper partition wall 122 and into the upper chamber 130. The weight 74 is within the upper chamber 130 and mounted on a free end of the shaft 76.

The positive electrical contact 80 extends from the distal end of the motor 72 through an opening 138 in the side partition wall 126 and into the back chamber 128. The positive electrical contact 80 is formed to electrically contact the proximal or positive end of the battery 70. The negative electrical contact 82 is formed to extend axially adjacent the outer surface of a lower portion of the motor 72 adjacent a front side of the body 116, that is, the side opposite the battery 70 and access door 118. The on-off electrical contact 86 is formed such that a first end is in electrical contact with the distal or negative end of the battery 70 within the back chamber 128 and a second end is located radially outward of the negative electrical contact 82. The on-off electrical contact 86 extends through openings 140, 142 in the side and lower partition walls respectively 126, 124.

An on-off switch or switching member 144 is slidably attached to a front side of the body 116 on the outer wall 120 adjacent the intermediate chamber 132. Switching member 144 is slidably attached in any suitable manner known to those skilled in the art. Extending outwardly from the switching member 144 are the attachment members 42, 44. The switching member 144 is slidable between two positions: a first or off-position; and a second or on-position. In the off-position, the switching member 144 is in its lower most position against an abutment 146 extending from the outer wall 120 of the body 116. In this position, the switching member 144 cannot downwardly move relative to the body 116 but can upwardly move relative to the body 116 to the on-position. The switching member 144 includes a cam element 148 which extends into the intermediate chamber 132 through an opening 150 in the side wall 120. In the off-position, the on-off electrical contact 86 is not in electrical contact with the negative electrical contact 82. In the on-position, the switching member 144 is moved upwardly from the off-position, so that the cam element 148 inwardly deflects the on-off electrical contact 86 toward and into electrical contact with the negative electrical contact 82. When the on-off electrical contact 86 is in electrical contact with the negative electrical contact 82, the electrical circuit is complete and the motor 72 rotates the shaft 76 and the weight 74. When the switching member 144 is moved back to the off-position, the on-off electrical contact 86 resiliently deflects or springs outward to break the electrical contact with the negative electrical contact 82 so that the electrical circuit is open and the motor 72 stops rotating the shaft 76 and the weight 74.

In operation, the oscillating unit 114 is attached to the razor 10 by snapping the handle portion 18 of the razor 10 between the attachment members 42, 44. The operator slides the switching member 144 upwardly from the off-position to the on-position where the on-off electrical contact 86 is in electrical contact with the negative electrical contact 82 so that electrical energy from the battery 70 is directed toward the motor 72. Energization of the motor 70 causes rotation of the shaft 76 and induces a vibration signal which is transmitted to the cutting blade 16 as discussed above. The body 116, the switching member 144 and the attachment members 42, 44 preferably comprise molded plastic material suitable for transmitting vibration signals. After the shaving operation, the switching member 144 is downwardly slid back to the off-position which disengages the on-off electrical contact 86 from the negative electrical contact 82 and interrupts the circuit of the motor 72.

Although particular embodiments of the invention have been described in detail, it will be understood that the invention is not limited correspondingly in scope, but includes all changes and modifications coming within the spirit and terms of the claims appended hereto.

What is claimed is:

1. An oscillating unit for a wet shave razor having a handle, said oscillating unit comprising:

a body forming a hollow interior cavity;

a motor mounted within said hollow interior cavity and having a rotatable shaft extending therefrom;

an eccentric element connected to said shaft and disposed within said hollow cavity for rotation to induce a vibration;

a battery operatively connected to said motor; and a pair of attachment members for removably attaching said body to the handle of the razor, wherein said attachment members are spaced apart to form a longitudinally extending channel narrower than the handle and are resiliently deflectable by the handle in a direction away from each other to form a resilient clamp for the handle therebetween so that the handle can be easily snapped into and out of said channel; and a switching member operatively connecting said motor and said battery for turning said motor on and off, said switching member being slidably connected to said body for movement relative to said body, wherein said attachment members are directly fixed to said switchng member so that movement of said switching member, along with said attachment members, relative to said body turns said motor on and off.

2. The oscillating unit according to claim 1, wherein said body comprises molded plastic.

3. The oscillating unit according to claim 1, wherein said attachment members are elongate and generally parallel.

4. The oscillating unit according to claim 1, wherein said attachment members comprise a flexible material for resiliently clamping the handle therebetween.

5. An oscillating razor comprising;

a wet shave razor having a handle, a head extending from one end of the handle; and at least one blade mounted within the head; and an oscillating unit including a body forming a hollow interior cavity, a motor mounted within said hollow interior cavity, and having a rotable shaft extending therefrom, an eccentric element connected to said shaft and disposed within said hollow cavity, a battery operatively connected to said motor, a pair of attachment members, wherein said attachment members are spaced apart to form a longitudinally extending channel and are laterally deflected by said handle in a direction away from each other, whereby said handle is resiliently clamped between said attachment members for removably attaching said body to said handle of said wet shave razor, and a switching member operatively connecting said motor and said battery for turning said motor on and off, said switching member being slidably connected to said body for movement relative to said body, wherein said attachment members are directly fixed to said switching member so that movement of said switching member, along with said attachment members and said wet shave razor, relative to said body turns said motor on and off.

6. The oscillating razor according to claim 5, wherein said wet shave razor is a disposable razor.

7. The oscillating razor comprising according to claim 5, wherein said body comprises molded plastic.

8. The oscillating razor according to claim 5, wherein said attachment members are elongate and generally parallel.

9. The oscillating razor according to claim 5, wherein said two attachment members comprise a flexible material for resiliently clamping the handle.

10. The new oscillating razor according to claim 5, wherein said channel is narrower than said handle of said wet shave razor.

11. An oscillating unit for a wet shave razor having a handle, said oscillating unit comprising:

a body forming a hollow interior cavity;

a motor mounted within said hollow interior cavity and having a rotatable shaft extending therefrom;

an eccentric element connected to said shaft and disposed within said hollow cavity for rotation to induce a vibration;

a battery operatively connected to said motor;

a switching member operatively connecting said motor and said battery for turning said motor on and off, said switching member being slidably connected to said body for movement relative to said body; and at least one attachment member connected to said body for removably attaching said body to the handle of the razor, wherein said attachment member is directly fixed to said switching member so that movement of said switching member, along with said attachment member, relative to said body turns said motor on and off.

* * * * *

UNITED STATES PATENT AND TRADEMARK OFFICE

CERTIFICATE OF CORRECTION

PATENT NO. : 5,732,470

DATED : March 31, 1998

INVENTOR(S) : A. Franklin Labarbara

It is certified that error appears in the above-indentified patent and that said Letters Patent is hereby corrected as shown below:

Column 1, line 12, please delete "Oscillating" and insert therefor -- oscillating--.

Column 3, line 38, please delete "Of" and insert therefor --of--.

Column 7, claim 10, line 20, after "the" please delete "new".

Signed and Sealed this

Twentieth Day of October, 1998

*Attest:*

*Attesting Officer*

BRUCE LEHMAN

*Commissioner of Patents and Trademarks*